US012012975B2

(12) United States Patent
Cho

(10) Patent No.: US 12,012,975 B2
(45) Date of Patent: Jun. 18, 2024

(54) VACUUM EJECTOR PUMP WITH MULTIPLE NOZZLES

(71) Applicant: VTEC CO., LTD., Busan (KR)

(72) Inventor: Ho-Young Cho, Seoul (KR)

(73) Assignee: VTEC CO., LTD., Busan (KR)

( * ) Notice: Subject to any disclaimer, the term of this patent is extended or adjusted under 35 U.S.C. 154(b) by 0 days.

(21) Appl. No.: 17/757,884

(22) PCT Filed: Apr. 4, 2022

(86) PCT No.: PCT/KR2022/004812

§ 371 (c)(1),
(2) Date: Jun. 22, 2022

(87) PCT Pub. No.: WO2022/244976

PCT Pub. Date: Nov. 24, 2022

(65) Prior Publication Data

US 2024/0068489 A1 Feb. 29, 2024

(30) Foreign Application Priority Data

May 18, 2021 (KR) ..... 10-2021-0064101

(51) Int. Cl.
*F04F 5/46* (2006.01)
*F04F 5/20* (2006.01)
*F04F 5/22* (2006.01)

(52) U.S. Cl.
CPC ..... *F04F 5/467* (2013.01); *F04F 5/22* (2013.01); *F04F 5/20* (2013.01)

(58) Field of Classification Search
CPC ..... F04F 5/22; F04F 5/467; F04F 5/44
See application file for complete search history.

(56) References Cited

U.S. PATENT DOCUMENTS 1,423,198 A * 7/1922 Davenport ..... F04F 5/22 417/189
3,191,620 A * 6/1965 Berg ..... F16K 15/026 137/551

(Continued)

FOREIGN PATENT DOCUMENTS

KR 100393434 B1 8/2003
KR 100629994 B1 10/2006

(Continued)

*Primary Examiner* — Nathan C Zollinger
(74) *Attorney, Agent, or Firm* — INNOVATION CAPITAL LAW GROUP, LLP; Vic Lin

(57) ABSTRACT

The present invention relates to a vacuum ejector pump including a plurality of nozzles, which are assembled, and activated by compressed air passing through the nozzles at a high speed to generate a negative pressure in an outer surrounding space. The pump of the present invention includes an intermediate nozzle, a first nozzle on which a front-cover part inserted to an outer circumference of one end of the intermediate nozzle is formed, and a second nozzle on which a rear-cover part inserted to an outer circumference of the other end of the intermediate nozzle is formed. Here, the intermediate nozzle is disposed between the first nozzle and the second nozzle, and the intermediate nozzle, the first nozzle and the second nozzle constitute an ejector main body. The surrounding space communicates with each of the nozzles through a through-hole defined in a sidewall of the ejector main body and a slot defined between the nozzles. The through-hole is opened and closed in a sealing manner by a valve member having a properly designed shape.

5 Claims, 3 Drawing Sheets

(56) References Cited

U.S. PATENT DOCUMENTS

| | | | | | |
|---|---|---|---|---|---|
| 4,210,166 | A * | 7/1980 | Munie | B01F 25/4335 | 137/271 |
| 4,395,202 | A | 7/1983 | Tell | | |
| 4,466,778 | A * | 8/1984 | Volkmann | F04F 5/44 | 417/174 |
| 4,759,691 | A | 7/1988 | Kroupa | | |
| 4,790,054 | A | 12/1988 | Nichols | | |
| 4,880,358 | A | 11/1989 | Lasto | | |
| 5,169,293 | A | 12/1992 | Yamamoto | | |
| 5,228,839 | A | 7/1993 | Peterson et al. | | |
| 5,683,227 | A | 11/1997 | Nagai et al. | | |
| 6,394,760 | B1 | 5/2002 | Tell | | |
| 6,582,199 | B1 | 6/2003 | Volkmann | | |
| 6,585,695 | B1 | 7/2003 | Adair et al. | | |
| 7,438,535 | B2 | 10/2008 | Morishima | | |
| 8,231,358 | B2 | 7/2012 | Cho | | |
| 9,382,922 | B2 * | 7/2016 | Dunning | F04F 5/44 | |
| 9,863,443 | B2 * | 1/2018 | Kaupp | F04F 5/22 | |
| 2005/0089408 | A1 * | 4/2005 | Solomon | B01F 25/31242 | 417/151 |
| 2007/0148009 | A1 * | 6/2007 | Cho | F04F 5/467 | 417/174 |

FOREIGN PATENT DOCUMENTS

| | | | |
|---|---|---|---|
| KR | 101039470 | B1 | 6/2011 |
| KR | 20130098036 | A * | 9/2013 |
| KR | 101677564 | B1 | 11/2016 |
| KR | 101685998 | B1 | 12/2016 |

* cited by examiner

[Fig.1]
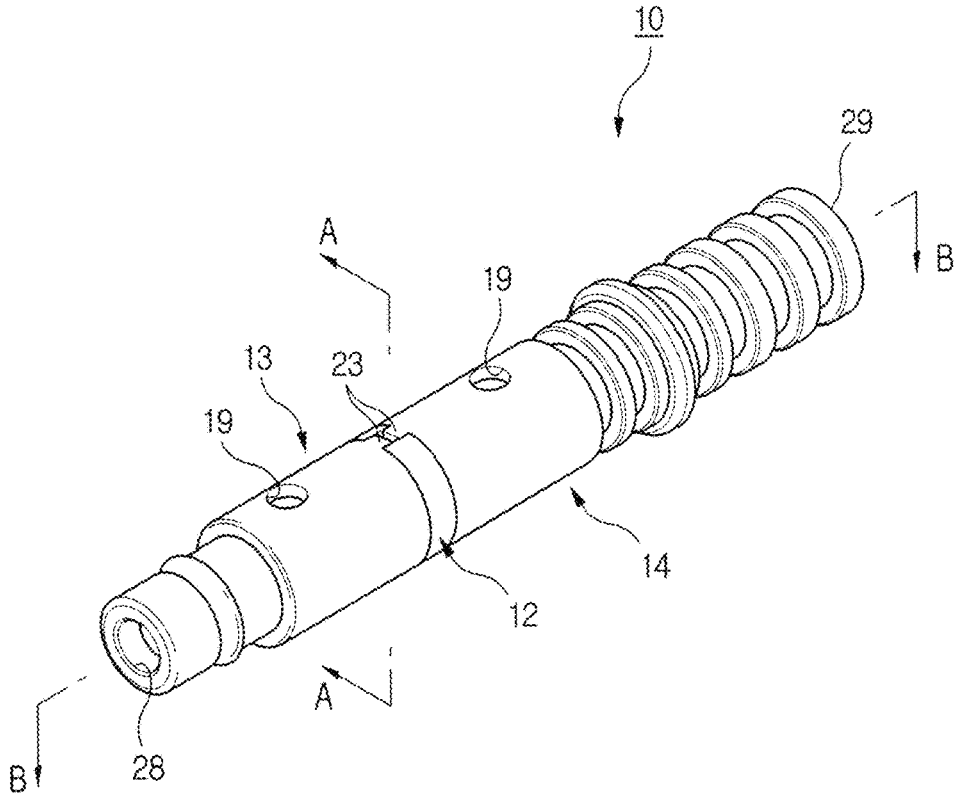
[Fig.2]
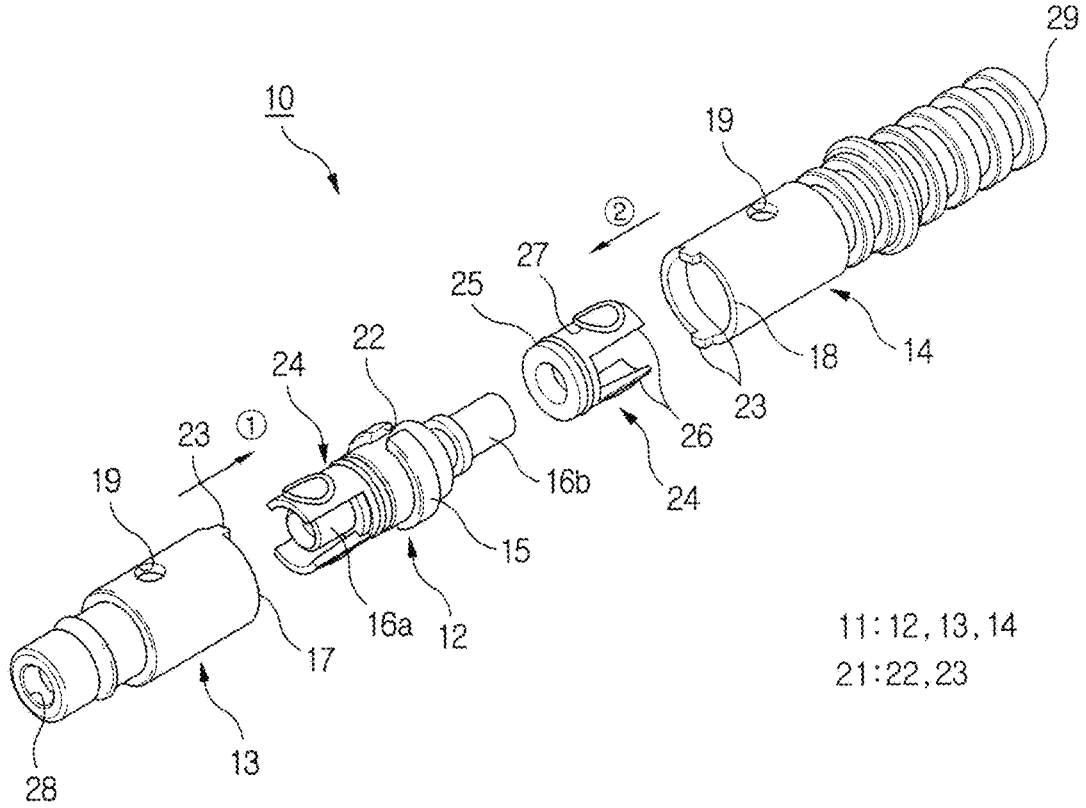

[Fig.3]
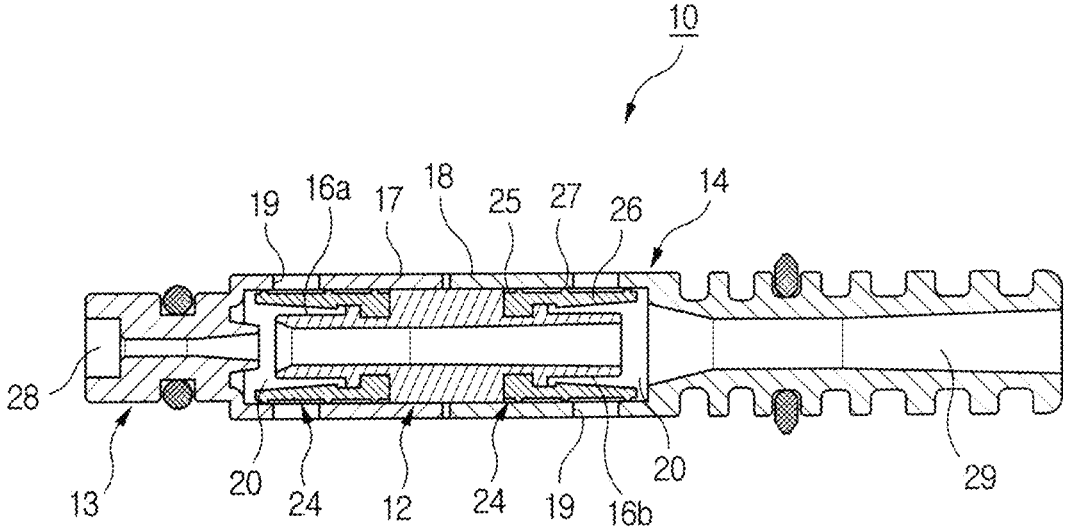
[Fig.4]
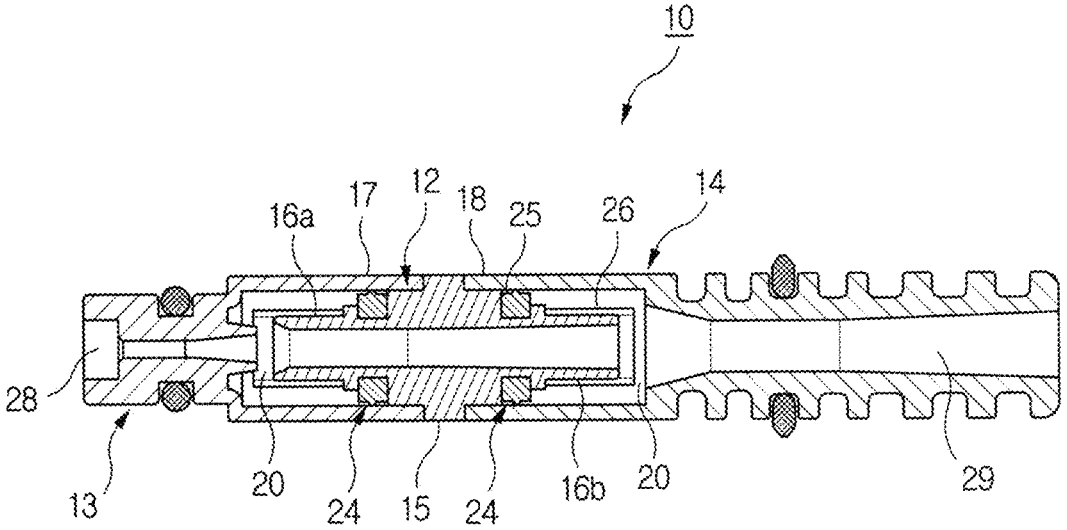

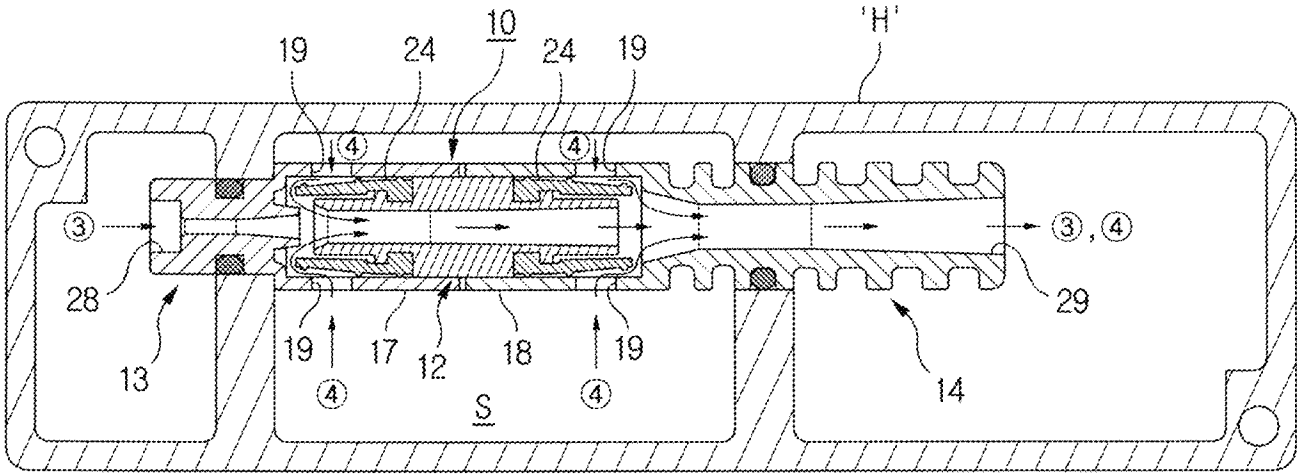
[Fig.5]

VACUUM EJECTOR PUMP WITH MULTIPLE NOZZLES

TECHNICAL FIELD

The present invention relates to a vacuum ejector pump, and more particularly, to a vacuum ejector pump activated by compressed air introduced and discharged at a high speed to generate a negative pressure in a predetermined space.

BACKGROUND ART

In general, a vacuum ejector pump that is a device used in a vacuum transfer system includes an ejector main body including multi-stage nozzles arranged in series, a through-hole defined in a sidewall of the main body, and a flexible valve installed inside the through-hole. Particularly, a small-sized vacuum ejector pump is directly mounted to the inside of a housing that requires exhaustion. Here, a vacuum chamber in the housing communicates with the through-hole. Also, a separate suction device, e.g., a suction cup or pad, is connected to the vacuum chamber to constitute the vacuum system.

When the compressed air supplied while the system operates is discharged by passing through the ejector main body at a high speed, the air in the vacuum chamber is introduced into the main body through the through-hole and discharged together with the compressed air. Thus, a vacuum and a negative pressure are generated in the vacuum chamber and the suction device, and when the generated negative pressure is equal to or less than a predetermined level, the through-hole is closed by a valve, and the vacuum chamber maintains the predetermined level. The negative pressure in the suction device generated in this process is used for gripping and transferring a product.

Each of Korean Patent Registration No. 10-0393434 (U.S. Pat. No. 6,394,760) and Korean Patent Registration No. 10-1039470 discloses a typical vacuum ejector pump. The former discloses a vacuum ejector pump in which a plurality of nozzles are assembled in a state of being arranged parallel in one direction, and a valve component is installed between the nozzles, and the latter discloses a vacuum ejector pump in which nozzles are assembled by using a separate cylindrical member.

Currently, the above-disclosed devices are substantially used in a working site of vacuum transferring. However, all of the devices have a problem of low productivity due to complex assembly of components;

a problem of a vulnerable and unstable structure in that each component, particularly a nozzle, is arbitrarily separated or rotated during usage; and a problem of generating vacuum leakage due to a weak sealing property, which causes an accident during vacuum transferring.

Furthermore, in case of the latter, production and assembly are complex and uneconomical due to a lot of components.

TECHNICAL DOCUMENTS OF RELATED ART

Korean Patent Registration No. 10-0393434
Korean Patent Registration No. 10-0629994
Korean Patent Registration No. 10-1039470
Korean Patent Registration No. 10-1685998

DISCLOSURE OF THE INVENTION

Technical Problem

The present invention is suggested to solve the above-described problems of the typical vacuum ejector pumps. The present invention provides a vacuum ejector pump that is easily assembled and manufactured, maintains a rigid and stable state, and minimizes vacuum leakage.

Technical Solution

The present invention provides a vacuum ejector pump including a plurality of nozzles, which are assembled, and activated by compressed air passing through the nozzles at a high speed to generate a negative pressure in an outer surrounding space, the vacuum ejector pump including:

a pipe-type intermediate nozzle having a longitudinal-direction channel;

a first nozzle on which a front-cover part inserted to an outer circumference of one end of the intermediate nozzle is formed; and a second nozzle on which a rear-cover part inserted to an outer circumference of the other end of the intermediate nozzle to face the front-cover part is formed;

wherein the intermediate nozzle is disposed between the first nozzle and the second nozzle, the intermediate nozzle, the first nozzle and the second nozzle constitute an ejector main body, and the surrounding space communicates with each of the nozzles through a through-hole defined in a sidewall of the ejector main body and a slot defined between the nozzles.

Here, the compressed air is introduced to the first nozzle, passes the intermediate nozzle, and then discharged to the outside through the second nozzle.

Preferably, the through-hole may pass through each of the cover parts.

Also, the intermediate nozzle may include a ring-shaped stopper flange formed on an outer circumference of a central portion of the intermediate nozzle, and ends of the front-cover part and the rear-cover part may be in contact with both side surfaces of the flange to face each other, respectively.

The ejector main body may include a mutual hook structure disposed between the intermediate nozzle and each of the cover parts to prevent each of the nozzles that are assembled from arbitrarily rotating. Specifically, the hook structure may be a 'key-key groove' corresponding structure, and the key groove and the key are disposed on ends of the flange and the cover parts, respectively, so that the key groove and the key correspond to each other.

The vacuum ejector pump of the present invention may further include a flexible valve member installed in the ejector main body and configured to open and close the through-hole. Preferably, the valve member may be installed in a space between each of the cover parts of the first and second nozzles and the intermediate nozzle disposed between the first and second nozzles.

Specifically, the valve member may include: an O-ring inserted and fixed to an outer circumference of the intermediate nozzle; and a check valve flap extending from the O-ring to cover the through-hole. Preferably, the valve flap may include a sealing circle protruding a surface of the valve flap in the form of surrounding the through-hole.

Advantageous Effects

The vacuum ejector pump according to the present invention basically has the structure in which the cover parts of the first nozzle and the second nozzle are symmetrically inserted to both side ends of the intermediate nozzle, and this structure is easily assembled, simple, and rigid in comparison with other pump devices.

Preferably, the valve member is integrated with the O-ring and inserted to the intermediate nozzle. In this case, the valves may be easily configured and assembled and effectively block the unnecessary flow of the air to minimize the vacuum leakage of the device.

BRIEF DESCRIPTION OF THE DRAWINGS

FIG. 1 is a perspective view illustrating an outer shape of a vacuum pump according to an embodiment of the present invention.

FIG. 2 is an exploded view of FIG. 1.

FIG. 3 is a cross-sectional view taken along line 'A-A' of FIG. 1.

FIG. 4 is a cross-sectional view taken along line 'B-B' of FIG. 1.

FIG. 5 is a view for explaining an operation of the vacuum ejector pump of FIG. 1.

DESCRIPTION OF REFERENCE NUMERALS

10: Vacuum ejector pump
11: Ejector main body
12: Intermediate nozzle
13: First nozzle 14: Second nozzle
15: Flange
16*a*: One end 16*b*: The other end
17: Front-cover part 18: Rear-cover part
19: Through-hole
20: Slot
21: Hook structure
22: Key groove 23: Key
24: Valve member
25: O-ring 26: Valve flap
27: Circle
28: Inlet 29: Outlet
H: Housing
S; Surrounding space

MODE FOR CARRYING OUT THE INVENTION

Characteristics and effects of the 'vacuum ejector pump' of the present invention, which are described or not described above, will be clarified through embodiments described below with reference to the accompanying drawings. In FIGS. 1 to 5, a reference numeral '10' indicates the vacuum ejector pump according to an embodiment of the present invention.

Referring to FIGS. 1 to 4, a vacuum ejector pump 10 of the present invention is a device including a plurality of nozzles 12, 13, and 14 arranged in series and activated by compressed air passing through the nozzles 12, 13, and 14 at a high speed to exhaust an outer surrounding space (refer to 'S' of FIG. 5), thereby generating a negative pressure therein, like a typical vacuum ejector pump. Specifically, the vacuum ejector pump 10 includes an ejector main body 11 including a pipe-type intermediate nozzle 12 having a channel in a longitudinal direction (a horizontal direction in the drawing) and first and second nozzles 13 and 14 that are respectively assembled to both sides of the intermediate nozzle 12.

Reference numeral 28 indicates a compressed air inlet defined in the first nozzle 13, and reference numeral 29 indicates an outlet defined in the second nozzle 14. The compressed air is supplied to the first nozzle 13, passes through the intermediate nozzle 12, and then discharged to the outside through the second nozzle 14.

Specifically, the first nozzle 13 is integrated with a front-cover part 17 inserted to an outer circumference of one end 16*a* of the intermediate nozzle 12, and the second nozzle 14 is integrated with a rear-cover part 18 inserted to an outer circumference of the other end 16*b* of the intermediate nozzle 12. That is, the front-cover part 17 and the rear-cover part 18 are inserted and assembled in opposite directions (refer to arrows ① and ② of FIG. 2) while respectively accommodating the both ends 16*a* and 16*b* of the intermediate nozzle 12, thereby constituting the ejector main body 11 including the three nozzles 12, 13, and 14.

The above-described structure of the ejector main body 11 is easily assembled, simple, rigid, and stable in comparison with a typical other nozzle structures.

Here, the surrounding space S communicates with each of the nozzles 12, 13, and 14 a through-hole 19 defined in a sidewall of the ejector main body 11 and a slot 20 formed between channels of the nozzles 12, 13, and 14. The slot 20 serves as a passage that allows the through-hole 19 to communicate with each of the nozzles 12, 13, and 14. However, the embodiment of the present invention is not limited to the specific name or shape thereof. The through-hole 19 passes through each of the cover parts 17 and 18 for convenience of processing.

The intermediate nozzle 12 includes a ring-shaped stopper flange 15 formed on an outer circumference of a central portion thereof for convenience of assembly of the ejector main body 11, and thus the front-cover part 17 and the rear-cover part 18 are inserted such that ends thereof respectively contact both opposite side surfaces of the flange 15.

The ejector main body 11 further includes a mutual hook structure 21 formed between the intermediate nozzle 12 and each of the cover parts 17 and 18 to prevent an arbitrary rotation of each of the assembled nozzles 12, 13, and 14. Specifically, the mutual hook structure 21 has a 'key 23—key groove 22' structure, and preferably corresponds to the flange 15 and the end of each of the cover parts 17 and 18.

The vacuum ejector pump 10 of the present invention further includes a flexible valve member 24 installed in the ejector main body 11 to open and close the through-hole 19. Preferably, the valve member 24 is installed in a space between each of the cover parts 17 and 18 of the first and second nozzles 13 and 14 and each of the ends 16*a* and 16*b* of the intermediate nozzle 12 disposed therebetween.

Specifically, the valve member 24 includes an O-ring 25 inserted to the outer circumference of the intermediate nozzle 12 and a check valve flap 26 extending from the O-ring 25 to cover the through-hole 19. Preferably, the valve flap 26 includes a sealing circle 27 protruding from a surface thereof in the form of surrounding the through-hole 19.

When the vacuum ejector pump 10 of the present invention is assembled, the valve member 24 is firstly installed at the end 16*a* and 16*b* of the intermediate nozzle 12, and then the groove 22 and the key 23 are aligned while inserting the cover parts 17 and 18 of the first and second nozzles 13 and 14 to both sides of the intermediate nozzle 12 in opposite directions (refer to arrows ① and ② of FIG. 2), so that the valve flap 26 naturally covers the through-hole 19.

Referring to FIG. 5, the vacuum ejector pump 10 of the present invention is mounted to the inside of a separately provided housing H and exhaust the surrounding space S, i.e., a vacuum chamber in the housing H. For example, a suction device communicating with the surrounding space S such as a suction cup or pad may be connected to the housing H. Firstly, a high speed compressed air is supplied to the inlet 28 of the first nozzle 13, passes through the intermediate nozzle 12, and discharged to the outside through the outlet of the third nozzle (refer to an arrow ③).

In this process, pressure drop is generated in the slot 20 between the nozzles 12, 13, and 14, and the valve flap 25 operates to open the through-hole 19. In this state, the surrounding space S is exhausted. That is, the air in the surrounding space S is introduced into the ejector main body 11 through the through-hole 19 and the slot and discharged to the outside together with the compressed air (refer to an arrow ④). This exhausting process generates a vacuum and a negative pressure in the surrounding space S and the suction device.

Thus, when an inner pressure level of the surrounding space S is equal to an inner pressure level of the ejector main body 11, the valve flap 26 operates reversely to close the through-hole 19. Thus, the vacuum and the negative pressure are generated and maintained in the inside of the surrounding space S and the suction device, and the vacuum transfer system may grip and transfer a product by using the generated negative pressure.

Here, when sealing between the through-hole 19 and the valve member 24 is weak, the air may be introduced into the surrounding space S through the through-hole 19 to instantly break the generated vacuum and negative pressure, and thus a transferring product may be dropped. In order to prevent this limitation, in a case, the compressed air may be continuously supplied. However, in this case, a huge energy loss may be generated. In another case, various kinds of sealing components may be used. However, this case may cause inconvenience and complexity, and an effect thereof is insignificant.

In comparison with the above-described cases, the valve member 24 of the present invention may have a simple configuration and be easily installed as the O-ring 25 and the valve flap 26 are integrated with each other and effectively perform opening-closing and sealing of the through-hole 19. Also, as the properly designed sealing circle 27 is provided, the sealing of the through-hole 19 may be strengthened.

The invention claimed is:

1. A vacuum ejector pump comprising a plurality of nozzles, which are assembled, and activated by compressed air passing through the nozzles at a high speed to generate a negative pressure in an outer surrounding space (S), the vacuum ejector pump comprising:

a pipe-type intermediate nozzle (12) having a longitudinal-direction channel;

a first nozzle (13) having a front-cover part (17) is disposed about an outer circumference of one end (16*a*) of the intermediate nozzle (12); and a second nozzle (14) having a rear-cover part (18) is disposed about an outer circumference of the other end (16*b*) of the intermediate nozzle (12) to face the front-cover part (17);

wherein the intermediate nozzle (12) is disposed between the first nozzle (13) and the second nozzle (14), the intermediate nozzle (12), the first nozzle (13) and the second nozzle (14) constitute an ejector main body (11), the surrounding space (S) communicates with each of the nozzles (12, 13, 14) through a through-hole (19) defined in the front-cover part (17) and the rear-cover part (18) of the ejector main body (11) and a slot (20) defined between the nozzles (12, 13, 14), the intermediate nozzle (12) comprises a ring-shaped stopper flange (15) formed on an outer circumference of a central portion of the intermediate nozzle (12), and ends of the front-cover part (17) and the rear-cover part (18) are in contact with both side surfaces of the flange (15) to face each other, respectively, the ejector main body (11) comprises a mutual hook structure (21) disposed between the intermediate nozzle (12) and each of the cover parts (17, 18) to prevent each of the nozzles (12, 13, 14) that are assembled from arbitrarily rotating, and the hook structure (21) is a 'key (23)-key groove (22)' corresponding structure, and the key groove (22) and the key (23) are disposed on ends of the flange (15) and the cover parts (17, 18), respectively, so that the key groove (22) and the key (23) correspond to each other.

2. The vacuum ejector pump of claim 1, wherein the through-hole (19) passes through each of the cover parts (17, 18).

3. The vacuum ejector pump of claim 1, wherein the vacuum ejector pump further comprises a flexible valve member (24) installed in the ejector main body (11) and configured to open and close the through-hole (19), and the valve member (24) is installed in a space between each of the cover parts (17, 18) of the first and second nozzles (13, 14) and the intermediate nozzle (12) disposed between the first and second nozzles (13, 14).

4. The vacuum ejector pump of claim 3, wherein the valve member (24) comprises:

an O-ring (25) inserted and fixed to an outer circumference of the intermediate nozzle (12); and a check valve flap (26) extending from the O-ring (25) to cover the through-hole (19).

5. The vacuum ejector pump of claim 4, wherein the valve flap (26) comprises a sealing circle (27) protruding from a surface of the valve flap (26) in the form of a circle surrounding the through-hole (19).

* * * * *